US010621823B2

(12) United States Patent
Soussa et al.

(10) Patent No.: US 10,621,823 B2
(45) Date of Patent: Apr. 14, 2020

(54) SYSTEMS AND METHODS FOR PROVIDING INTERACTION WITH A TERMINAL

(75) Inventors: Andre Soussa, North Ryde (AU); Geoffrey Engel, North Ryde (AU)

(73) Assignee: GLOBAL PAYMENT TECHNOLOGIES AUSTRALIA PTY LTD, North Ryde (AU)

( * ) Notice: Subject to any disclaimer, the term of this patent is extended or adjusted under 35 U.S.C. 154(b) by 831 days.

(21) Appl. No.: 12/945,607

(22) Filed: Nov. 12, 2010

(65) Prior Publication Data

US 2011/0114442 A1 May 19, 2011

(30) Foreign Application Priority Data

Nov. 16, 2009 (AU) ..... 2009905598

(51) Int. Cl.

| | |
|---|---|
| ***G07F 17/32*** | (2006.01) |
| ***G07D 11/20*** | (2019.01) |
| ***G07F 7/00*** | (2006.01) |
| ***G07F 7/02*** | (2006.01) |

(52) U.S. Cl.

CPC ..... *G07F 17/3232* (2013.01); *G07D 11/20* (2019.01); *G07F 7/00* (2013.01); *G07F 7/02* (2013.01); *G07F 17/32* (2013.01); *G07F 17/3223* (2013.01); *G07F 17/3225* (2013.01); *G07F 17/3244* (2013.01); *G07F 17/3251* (2013.01)

(58) Field of Classification Search

CPC ..... G07D 7/0093; G07D 7/02; G07D 11/20; G07F 17/3244; G07F 17/3251; G07F 17/3232; G07F 17/3225; G07F 7/00; G07F 7/02; G07F 17/17; G07F 17/3223; G07F 17/32

USPC ..... 705/66–68, 35–45, 50; 194/205–213, 194/214; 209/534; 235/379

See application file for complete search history.

(56) References Cited

U.S. PATENT DOCUMENTS

| | | | | |
|---|---|---|---|---|
| 6,371,473 | B1 * | 4/2002 | Saltsov et al. | 271/3.01 |
| 7,089,420 | B1 * | 8/2006 | Durst | G09C 5/00 283/72 |
| 7,113,929 | B1 * | 9/2006 | Beach | G06Q 20/367 194/216 |

(Continued)

FOREIGN PATENT DOCUMENTS

| | | | | |
|---|---|---|---|---|
| DE | 010121172 | A1 * | 10/2002 | G07D 7/0093 |
| GB | 1391060 | | 4/1975 | |

(Continued)

OTHER PUBLICATIONS

English Translation of JP2002210207A.*
English Translation of Abstract of DE 10121172 A1.*

*Primary Examiner* — Jeffrey A Shapiro
(74) *Attorney, Agent, or Firm* — Seed Intellectual Property Law Group LLP

(57) ABSTRACT

Described herein are systems and methods for providing interaction with a terminal. For example, various embodiments take the form of validators, validator components, components for interaction with validators, and software/methods for the operation of such validators and components. One embodiment provides a networked validator having functionality to display information via a LCD equipped bezel, interact with varied forms of token via a common input portal, and/or dispense printed tickets though an aperture inherently adapted to receive currency notes.

10 Claims, 7 Drawing Sheets

(56) References Cited

U.S. PATENT DOCUMENTS 7,247,098 B1 7/2007 Bradford et al. ..... 463/47
8,550,900 B2 * 10/2013 Walker ..... G07F 17/34 463/25
8,597,107 B2 * 12/2013 Delaney ..... G06Q 20/045 463/16
8,641,532 B2 * 2/2014 Morrow ..... G07F 17/32 463/20
8,910,771 B2 * 12/2014 Robinson ..... G07D 11/0018 194/203
2003/0014370 A1 * 1/2003 Charrin ..... 705/65
2003/0080032 A1 * 5/2003 Heidel et al. ..... 209/534
2003/0155210 A1 * 8/2003 Heidel et al. ..... 194/206
2004/0149817 A1 * 8/2004 Kuroiwa ..... G06Q 20/341 235/379
2004/0217536 A1 * 11/2004 Isobe ..... B65H 29/46 271/3.14
2004/0238319 A1 * 12/2004 Hand et al. ..... 194/207
2005/0009607 A1 * 1/2005 Russell et al. ..... 463/42
2005/0040225 A1 * 2/2005 Csulits ..... G07D 11/0003 235/379
2005/0150740 A1 * 7/2005 Finkenzeller ..... G07F 1/06 194/207
2005/0189416 A1 * 9/2005 Charrin ..... 235/440
2005/0194233 A1 * 9/2005 Yoshioka ..... 194/346
2005/0282627 A1 * 12/2005 Hedrick et al. ..... 463/25
2006/0293783 A1 * 12/2006 Hand et al. ..... 700/231
2007/0100750 A1 * 5/2007 Hartfield et al. ..... 705/43
2008/0015032 A1 1/2008 Bradford et al. ..... 463/47
2008/0032801 A1 * 2/2008 Brunet de Courssou ..... 463/42
2008/0060908 A1 * 3/2008 Abe et al. ..... 194/302
2008/0076536 A1 * 3/2008 Shayesteh ..... G07F 1/06 463/25
2008/0108404 A1 * 5/2008 Iddings ..... G07F 17/32 463/16
2008/0190730 A1 * 8/2008 Smith ..... G07D 11/0006 194/206
2009/0001661 A1 * 1/2009 Klein et al. ..... 271/258.01
2009/0111562 A1 * 4/2009 Chudd et al. ..... 463/20
2009/0176582 A1 7/2009 Cole et al. ..... 463/46
2009/0242353 A1 * 10/2009 Yu ..... G07D 11/0018 194/207
2009/0254484 A1 * 10/2009 Forero et al. ..... 705/68
2009/0260948 A1 * 10/2009 Matsumoto ..... 194/302
2010/0026460 A1 * 2/2010 Lee ..... G06K 7/0008 340/10.1
2010/0029380 A1 * 2/2010 Rhoads et al. ..... 463/29
2010/0093429 A1 * 4/2010 Mattice ..... G07F 1/06 463/25
2010/0285869 A1 * 11/2010 Walker ..... G07F 17/32 463/25
2011/0093116 A1 * 4/2011 Nunn ..... 700/219
2011/0124405 A1 * 5/2011 Okada et al. ..... 463/25

FOREIGN PATENT DOCUMENTS

JP 2002210207 A * 7/2002 ..... A63F 7/02
WO 03/028826 4/2003
WO 2005/029226 3/2005
WO 2008/060953 5/2008

* cited by examiner

SYSTEMS AND METHODS FOR PROVIDING INTERACTION WITH A TERMINAL

FIELD OF THE INVENTION

The present invention relates to systems and methods for providing interaction with a terminal. For example, various embodiments take the form of validators, validator components, components for interaction with validators, and software/methods for the operation of such validators and components. Embodiments of the invention have been particularly developed for enhancing the operation of a terminal as a result of validator functionality. While some embodiments will be described herein with particular reference to that application, it will be appreciated that the invention is not limited to such a field of use, and is applicable in broader contexts.

BACKGROUND

Any discussion of the background art throughout the specification should in no way be considered as an admission that such art is widely known or forms part of common general knowledge in the field.

Various forms of terminals make use of validators for accepting payment (for example by way of currency notes). Examples include electronic gaming machines (such as poker machines or slot machines), vending machines (such as those used to dispense food and/or beverages), and banking machines (such as ATM machines).

There is a need in the art for improved validators, and more generally for new and improved systems and methods for providing interaction with a terminal.

SUMMARY OF THE INVENTION

It is an object of the present invention to overcome or ameliorate at least one of the disadvantages of the prior art, or to provide a useful alternative.

One embodiment provides a validator for operation with a terminal, the validator including:

a central processing unit;

a memory module coupled to the central processing unit, the memory module configured for maintaining software instructions that are executable via the central processing unit;

a primary communications port coupled to the central processing unit, wherein the primary communications port is configured for coupling the validator to the terminal for allowing interaction between the validator and the terminal;

a transportation mechanism coupled to the central processing unit, wherein the transportation mechanism is responsive to a first signal from the central processing unit for transporting a substrate received via a primary input aperture to a specified location, and responsive to a second signal from the central processing unit for transporting a substrate received from a secondary input location to the primary input aperture, wherein the primary input aperture is, in use, presented externally of the terminal; and an input portal coupled to the central processing unit, wherein the input portal is configured for receiving multiple forms of token, wherein one of the forms of token includes a physical substrate for providing payment.

One embodiment provides a validator wherein the secondary input location is coupled to a token recycling device, the token recycling device being configured to receive a token from the transportation mechanism, store that token, and deliver that token to the transportation mechanism following an instruction from the central processing unit.

One embodiment provides a validator wherein the recycling device is configured to store a plurality of tokens.

One embodiment provides a validator wherein the secondary input location is coupled to a token recycling device, the token recycling device being configured to receive a reusable non-currency token from the transportation mechanism, store that token, and deliver that token to the transportation mechanism following an instruction from the central processing unit.

One embodiment provides a validator is configured to maintain a record of an identifier of the reusable non-currency token.

One embodiment provides a validator that is configured to associate the identifier of the reusable non-currency token with a purpose data.

One embodiment provides a validator wherein the purpose data includes a monetary value.

One embodiment provides a validator that is configured to read the identifier of the reusable non-currency token upon insertion of that token into the validator, and determine the associated purpose data.

One embodiment provides a validator that is configured to subsequently associate the non-currency token with different purpose data prior to that token being dispensed by the validator.

One embodiment provides a validator wherein the secondary input location is coupled to a ticket dispenser, such that the ticket dispenser is configured to present a ticket to the transportation mechanism at the secondary input location.

One embodiment provides a method for operating a validator, the method including:

receiving a token;

analysing the token to determine whether it is a predefined form of reusable non-currency token;

in the case that the token is a predefined form of reusable non-currency token:

analysing the token to determine purpose data associated with the token; and storing the token in a token recycling device, such that the token can subsequently be associated with new purpose data and dispensed from the validator.

One embodiment provides a method including a step of receiving a command to dispense a token associated with specified purpose data, retrieving a reusable non-currency token from the recycling device, associating that token with the specified purpose data, and dispensing that token.

One embodiment provides a validator for operation with a terminal, the validator including:

a central processing unit;

a memory module coupled to the central processing unit, the memory module configured for maintaining software instructions that are executable via the central processing unit;

a primary communications port coupled to the central processing unit, wherein the primary communications port is configured for coupling the validator to the terminal for allowing interaction between the validator and the terminal;

an input portal coupled to the central processing unit, wherein the input portal is configured for receiving payment tokens;

a validation module for validating a payment token thereby to determine whether the payment token is to be accepted or rejected; and an identification token reader for reading an identification token provided by a user of the terminal;

wherein the validation module is configured to selectively accept or reject a payment token responsive to assessment of a read identification token, such that the decision to accept or reject a payment token is responsive to the identification of the user present at the terminal when the payment terminal is provided.

One embodiment provides a validator wherein the input portal is configured to receive currency tokens, and the decision to selectively accept or reject a currency token includes assessment of player characteristics associated with the read identification token.

One embodiment provides a validator wherein the player characteristics associated with the read identification token include historical payment data for the user.

One embodiment provides a validator wherein the input portal is configured to receive non-currency tokens, wherein each non-currency token is associated with identification data, and wherein the non currency token is accepted only in the case that the identification data associated with the non-currency token corresponds to the identification token read by the identification token reader.

One embodiment provides a validator wherein the identification token reader is configured for wirelessly for reading an identification token provided by a user of the terminal.

One embodiment provides a validator wherein the input portal is operative only in the case that the identification token reader recognises that an identification token is present.

One embodiment provides a validator for operation with a terminal, the validator including:

a central processing unit;

a memory module coupled to the central processing unit, the memory module configured for maintaining software instructions that are executable via the central processing unit;

a primary communications port coupled to the central processing unit, wherein the primary communications port is configured for coupling the validator to the terminal for allowing interaction between the validator and the terminal;

one or more secondary communications ports coupled to the central processing unit, wherein the one or more secondary communications ports are configured for allowing connection of one or more peripheral components for allowing interaction between the validator and such components;

a transportation mechanism coupled to the central processing unit, wherein the transportation mechanism is responsive to a first signal from the central processing unit for transporting a substrate received via a primary input aperture to a specified location, and responsive to a second signal from the central processing unit for transporting a substrate received from a ticket printer to the primary input aperture, wherein the primary input aperture is, in use, presented externally of the terminal; and an input portal coupled to the central processing unit, wherein the input portal is configured for receiving multiple forms of token, wherein one of the forms of token includes a physical substrate for providing payment.

One embodiment provides a validator wherein the validator includes a secondary input aperture that in use is presented internally of the terminal, and wherein the secondary input aperture is coupled to an output of a ticket printer such that substrate received from the ticket printer is positioned for transportation by the transportation mechanism.

One embodiment provides a validator wherein the ticket printer is coupled to the validator via one of the secondary communications ports.

One embodiment provides a validator wherein the validator includes a ticket printer positioned such that such that a substrate delivered by the ticket printer is positioned for transportation by the transportation mechanism.

One embodiment provides a validator wherein the second signal is generated in response to a signal from the ticket printer.

One embodiment provides a validator wherein one of the secondary communications ports is configured for coupling to a bezel, the bezel having a display screen, and wherein the memory unit and CPU are configured for driving the display screen.

One embodiment provides a validator wherein the validator includes a bezel having a display screen, and wherein the memory unit and CPU are configured for driving the display screen.

One embodiment provides a validator wherein the display screen includes a plurality of LEDs arranged to allow presentation of controllable alphanumeric information under instructions of the central processing unit.

One embodiment provides a validator wherein the display screen includes a LCD display.

One embodiment provides a validator wherein the display screen is configured for providing video data.

One embodiment provides a validator wherein the display screen is configured for providing diagnostic information in relation to the validator.

One embodiment provides a validator wherein the display screen is configured for providing diagnostic information in relation to the terminal.

One embodiment provides a validator wherein the display screen includes a touch-based input mechanism for providing input signals to the validator and/or terminal.

One embodiment provides a validator wherein the bezel includes an input mechanism for providing input signals to the validator and/or terminal.

One embodiment provides a validator wherein the input signals allow a user to obtain desired diagnostic information regarding at least one of the validator and the terminal.

One embodiment provides a validator wherein the input signals allow a user to provide identification information.

One embodiment provides a validator wherein the input portal is configured for receiving at least one form of token in physical form, and at least one form of token in digital form.

One embodiment provides a validator wherein the input portal is configured for receiving tokens in any one or more of the following forms:

currency notes;

non-currency printed substrates;

RFID or other wirelessly readable tokens;

smart cards;

magnetically readable substrates;

optically readable substrates.

One embodiment provides a validator wherein the input portal defines a token acceptance zone into which a token of any of the multiple forms is presented for receiving by the input portal.

One embodiment provides a validator including a network interface coupled to the central processing unit for allowing the validator to participate in a validator network including a plurality of validators.

One embodiment provides a validator wherein the validator network includes a central server.

One embodiment provides a validator wherein the memory and central processing unit are configured to seek instructions from the central server in response to one or more local events at the validator.

One embodiment provides a validator the memory and central processing unit are configured to accept configuration data via the network interface.

One embodiment provides a validator wherein the memory and central processing unit are configured to firmware data via the network interface.

One embodiment provides a validator for operation with a terminal, the validator including:

a central processing unit;

a memory module coupled to the central processing unit, the memory module configured for maintaining software instructions that are executable via the central processing unit;

a primary communications port coupled to the central processing unit, wherein the primary communications port is configured for coupling the validator to the terminal for allowing interaction between the validator and the terminal;

one or more secondary communications ports coupled to the central processing unit, wherein the one or more secondary communications ports are configured for allowing connection of one or more peripheral components for allowing interaction between the validator and such components;

an input portal coupled to the central processing unit, wherein the input portal is configured for receiving multiple forms of token, wherein one of the forms of token includes a physical substrate for providing payment.

One embodiment provides a validator for operation with a terminal, the validator including:

a central processing unit;

a memory module coupled to the central processing unit, the memory module configured for maintaining software instructions that are executable via the central processing unit;

a primary communications port coupled to the central processing unit for interaction a primary communications port coupled to the central processing unit, wherein the primary communications port is configured for coupling the validator to the terminal for allowing interaction between the validator and the terminal; and one or more secondary communications ports coupled to the central processing unit, wherein the one or more secondary communications ports are configured for allowing connection of one or more peripheral components for allowing interaction between the validator and such components;

wherein one of the secondary communications ports is configured for coupling to a bezel, the bezel having a display screen, and wherein the memory unit and CPU are configured for driving the display screen.

One embodiment provides a validator for operation with a terminal, the validator including:

a central processing unit;

a memory module coupled to the central processing unit, the memory module configured for maintaining software instructions that are executable via the central processing unit;

a primary communications port coupled to the central processing unit, wherein the primary communications port is configured for coupling the validator to the terminal for allowing interaction between the validator and the terminal;

one or more secondary communications ports coupled to the central processing unit, wherein the one or more secondary communications ports are configured for allowing connection of one or more peripheral components for allowing interaction between the validator and such components; and a bezel having a display screen, and wherein the memory unit and CPU are configured for driving the display screen.

One embodiment provides a validator for operation with a terminal, the validator including:

a central processing unit;

a memory module coupled to the central processing unit, the memory module configured for maintaining software instructions that are executable via the central processing unit;

a primary communications port coupled to the central processing unit, wherein the primary communications port is configured for coupling the validator to the terminal for allowing interaction between the validator and the terminal;

one or more secondary communications ports coupled to the central processing unit, wherein the one or more secondary communications ports are configured for allowing connection of one or more peripheral components for allowing interaction between the validator and such components; and a network interface coupled to the central processing unit for allowing the validator to participate in a validator network including a plurality of validators.

One embodiment provides a validator for operation with a terminal, the validator including:

a central processing unit;

a memory module coupled to the central processing unit, the memory module configured for maintaining software instructions that are executable via the central processing unit;

a primary communications port coupled to the central processing unit, wherein the primary communications port is configured for coupling the validator to the terminal for allowing interaction between the validator and the terminal; and a display screen and input mechanism coupled to the central processing unit, wherein the display screen and input mechanism are driven by the central processing unit there to provide a game of chance.

One embodiment provides a validator for operation with a terminal, the validator including:

a central processing unit;

a memory module coupled to the central processing unit, the memory module configured for maintaining software instructions that are executable via the central processing unit;

a primary communications port coupled to the central processing unit, wherein the primary communications port is configured for coupling the validator to the terminal for allowing interaction between the validator and the terminal;

one or more secondary communications ports coupled to the central processing unit, wherein the one or more secondary communications ports are configured for allowing connection of one or more peripheral components for allowing interaction between the validator and such components;

a transportation mechanism coupled to the central processing unit, wherein the transportation mechanism is responsive to a first signal from the central processing unit for transporting a substrate received via a primary input aperture to a specified location, and responsive to a second signal from the central processing unit for transporting a substrate received from a ticket printer to a location substantially adjacent the primary input aperture, wherein the primary input aperture is, in use, presented externally of the terminal; and an input portal coupled to the central processing unit, wherein the input portal is configured for receiving multiple forms of token, wherein one of the forms of token includes a physical substrate for providing payment.

One embodiment provides a validator wherein the memory module and central processing unit are configured for operation with a terminal in the form of an electronic gaming machine.

One embodiment provides a validator wherein the memory module and central processing unit are configured for operation with a terminal in the form of a banking machine.

One embodiment provides a validator wherein the memory module and central processing unit are configured for operation with a terminal in the form of a vending machine.

One embodiment provides a computer program product for a validator as described herein One embodiment provides a method for providing network functionality to a terminal, the method including connecting the terminal to a validator as described herein.

One embodiment provides a bezel for a validator, the bezel including display screen and an input for connection to a validator, such that the display screen is controllable by a memory unit and central processing unit of the validator.

One embodiment provides an input device for a transaction machine having a first controller, the interface including:

an interface for interacting with a coded token presented by a user, wherein the interface has an aperture and is responsive to the token for generating an assessment signal; and a second controller that is responsive to the assessment signal for selectively communicating with the first controller, and that is responsive to either one or both of the first controller and the assessment signal for presenting a printed token to the user via the aperture.

In one embodiment the device interacts successively with coded tokens, where those tokens are of two or more different types.

In one embodiment the types of coded tokens include two or more of: an RFID card; a currency note; a printed ticket; one or more coins; a magnetic strip card; and a smart card.

In one embodiment the printed token is generated by a printer in response to a print signal provided by the second controller.

In one embodiment the token is presented to the aperture by the user.

In one embodiment the transaction machine has a panel with an opening and the interface includes a bezel for mounting about the opening.

In one embodiment the bezel includes a dynamic visual display surface.

In one embodiment the bezel includes an engagement face adjacent to the aperture and upon which tokens are able to be placed and guided into the aperture.

In one embodiment the display face defines at least part of the engagement face.

In one embodiment the second controller is associated with a validator that is adjacent to the bezel.

In one embodiment the transaction machine is one of: an automated teller machine (ATM); an electronic gaming machine (EGM); or a dispensing machine.

One embodiment provides a bezel for a transaction machine having a panel with an opening extending between an interior side and an exterior side of the panel, the bezel including:

a body for extending through and being secured about the opening;

an aperture for receiving a coded token presented by a user; and a dynamic visual display surface extending along the housing on the exterior side of the panel.

In one embodiment the display surface selectively presents video images.

In one embodiment the display surface selectively receives input from the user.

In one embodiment the display surface is provided by a touch screen device.

In one embodiment the bezel includes an engagement surface adjacent to the aperture for assisting the user guide the token, wherein the display surface defines at least part of the engagement surface.

One embodiment provides an input device for a transaction machine having a first controller, the interface including:

an interface for interacting with a coded token presented by a user, wherein the interface is responsive to the token for generating an assessment signal; and a second controller that is responsive to the assessment signal for selectively communicating with the first controller; and a communications module for allowing the second controller to communicate with a remote controller.

In one embodiment the communications module communicates with the remote controller via a communications network.

In one embodiment the communications network is a wireless communications network.

In one embodiment the wireless communications network is defined, at least in part, by a plurality of like input devices.

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

BRIEF DESCRIPTION OF THE DRAWINGS

Preferred embodiments of the invention will now be described, by way of example only, with reference to the accompanying drawings in which.

DETAILED DESCRIPTION

Described herein are systems and methods for providing interaction with a terminal. For example, various embodiments take the form of validators, validator components, components for interaction with validators, and software/methods for the operation of such validators and components. One embodiment provides a networked validator having functionality to display information via a LCD equipped bezel, interact with varied forms of token via a common input portal, and/or dispense printed tickets though an aperture inherently adapted to receive currency notes.

Figure 1:
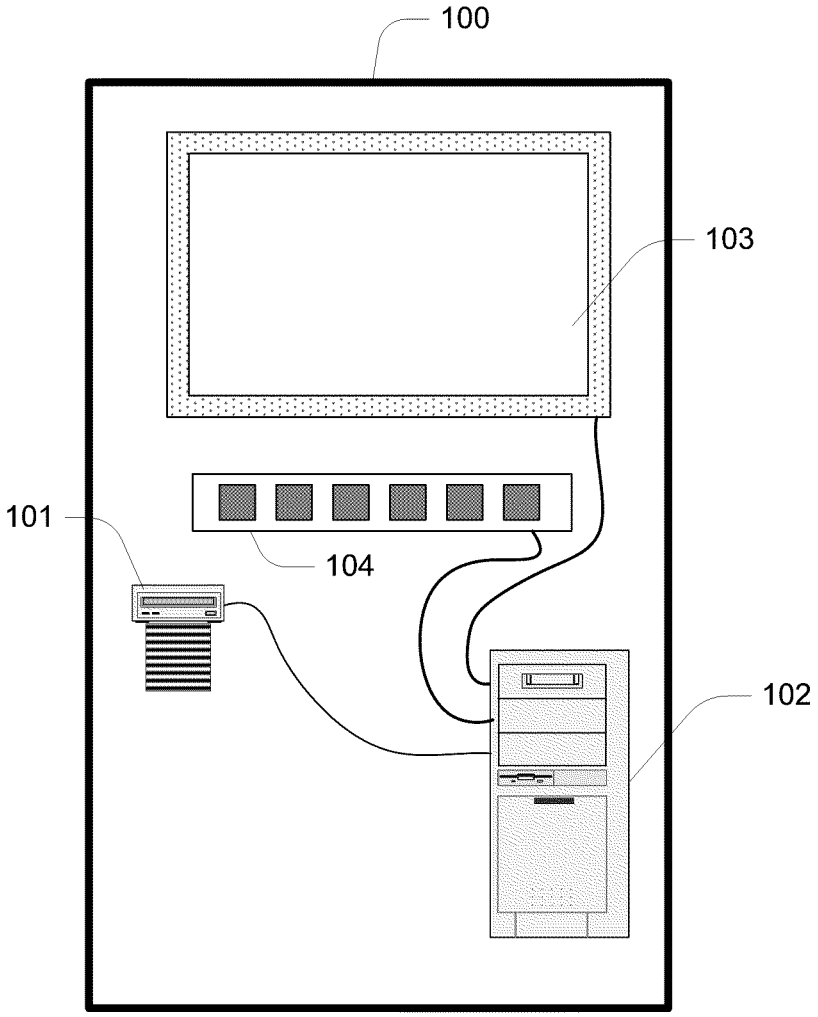
FIG. 1 is a schematic representation of a validator and terminal according to one embodiment.

Referring initially to FIG. 1, the present embodiments are generally directed to situations where a terminal 100 is configured to operate with a validator 101. The term "validator" is used to describe a piece of hardware configured for accepting payment, such as payment in the form of currency notes. As such, it should be assumed that a validator includes an input aperture into which physical payment substrates (such as currency notes) are inserted, and components for reading/validating those payment substrates. Based on that reading/validation, the validator provides selectively (or inherently) a signal to the terminal. For example, if a currency note is validated, the signal informs the terminal in relation to that currency note. A validator is a standalone unit with respect to the terminal, having its own processing and memory components. It should be appreciated that the operation of a validator as described herein is by no means limited to core functionality of accepting payment. The present embodiments utilize an appreciation that a validator operates as a significant entry point for accessing terminal functionalities, and extend validator functionalities accordingly.

Various forms of terminal 100 make use of validators for accepting payment (for example by way of currency notes). Examples include electronic gaming machines (such as poker machines or slot machines), vending machines (such as those used to dispense food and/or beverages), and banking machines (such as ATM machines). The present embodiments should not be limited to any particular form of terminal, unless specifically stated otherwise. The exemplary terminal 100 of FIG. 1 includes a central control unit 102, which is coupled to validator 101. Control unit 102 is additionally coupled to a display 103 and input device 104. In some embodiments terminal 100 includes additional components (such as mechanical components in the context of vending machines).

Figure 2A:
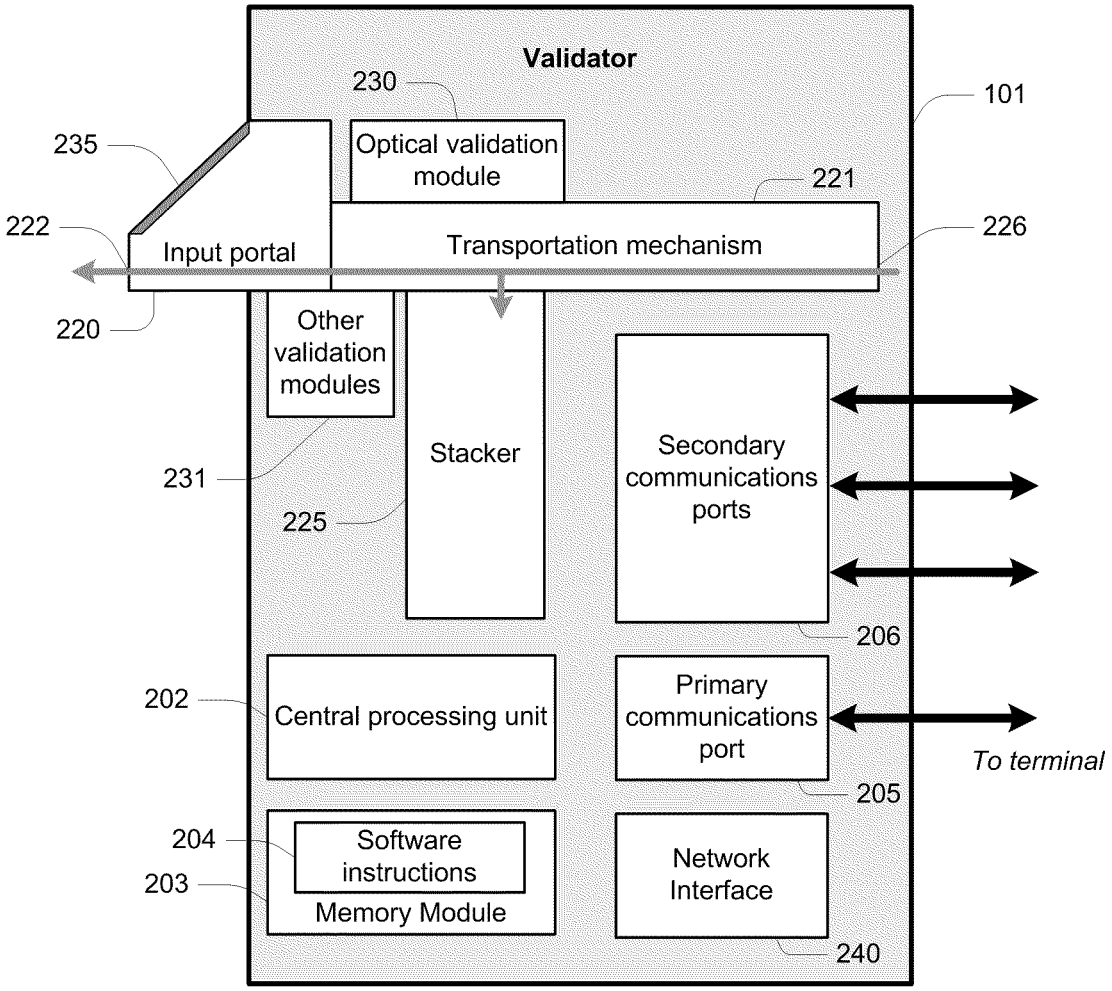
FIG. 2A is a schematic representation of a validator according to one embodiment.

FIG. 2A illustrates a validator 101 according to one embodiment. This validator is adapted for operation with a terminal such as terminal 100. Validator 101 includes a central processing unit, referred to herein as processor 202. This may take the form of (or include) a general purpose microprocessor, or a plurality of microprocessors. A memory module 203 is coupled to processor 202. Memory module 203 is configured for maintaining software instructions 204 that are executable via processor 202. It will be appreciated that these software instructions (which presently include validator firmware) provide various functionalities to validator 101, some of which being described in detail further below.

Validator 101 includes a primary communications port 205 coupled to processor 202. The primary communications port is configured for coupling the validator to the terminal for allowing interaction between the validator and the terminal. The nature of port 205 varies between embodiments, and may include a serial connection port, USB port, or other form of connection.

Validator 101 additionally includes one or more secondary communications ports 206. These are also coupled to processor 202. The communications ports are configured for allowing connection of one or more peripheral components for allowing interaction between the validator and such components. Once again, the nature of ports 206 varies between embodiments, and may include a serial connection ports, USB ports, or other forms of connection. Peripheral devices may include the likes of printers, displays, other input/output devices, and so on. Although ports 206 are illustrated as being commonly located, this is by no means necessary.

An input portal 220 is coupled to processor 102. The input portal is configured for receiving multiple forms of token. At least one of the forms of token includes a physical substrate for providing payment, such as currency notes. Various other forms of token are discussed further below.

Validator 101 includes a transportation mechanism 221 coupled to the central processing unit. Mechanism 221 is also physically coupled to input portal 220 (or appropriately located relative to the input portal), thereby to allow tokens in the form of substrates (including substrates that carry tokens) to be passed from and to the input portal. A grey line with arrows indicates the passage of substrates. However, it will be appreciated that this is indicative only, given the schematic nature of the present diagrams.

In the present embodiment, transportation mechanism 221 is responsive to a first signal from processor 202 for transporting a substrate received via a primary input aperture 222 at input portal 220 to a specified location (such as a stacker 225). The primary input aperture is, in use, presented externally of the terminal to allow a user to insert currency notes and the like. The first signal is in some embodiments initiated in response to sensing components observing the introduction of a substrate into the primary input aperture.

Mechanism 221 is additionally responsive to a second signal from the central processing unit for transporting a substrate received from a ticket printer (received at point 226) to input aperture 222, where it is dispensed. For example, the second signal is initiated in response to a signal from a ticket printer (external or integral), and causes mechanism 221 to operate in a different mode where the transportation path is varied (and reversed in the region adjacent primary input aperture 222). In this manner, aperture 222 is configured for both receiving substrates (such as currency notes and tickets) and for dispensing printed tickets. This arrangement allows for various functionalities that are present in embodiments, including but not limited to the following:

Providing receipts.

Providing tickets indicative of gaming value in the context of a ticket-based gaming environment.

Providing tickets that carry on them diagnostic information in relation to the validator or the terminal Providing promotional vouchers or the like.

Figure 2B:
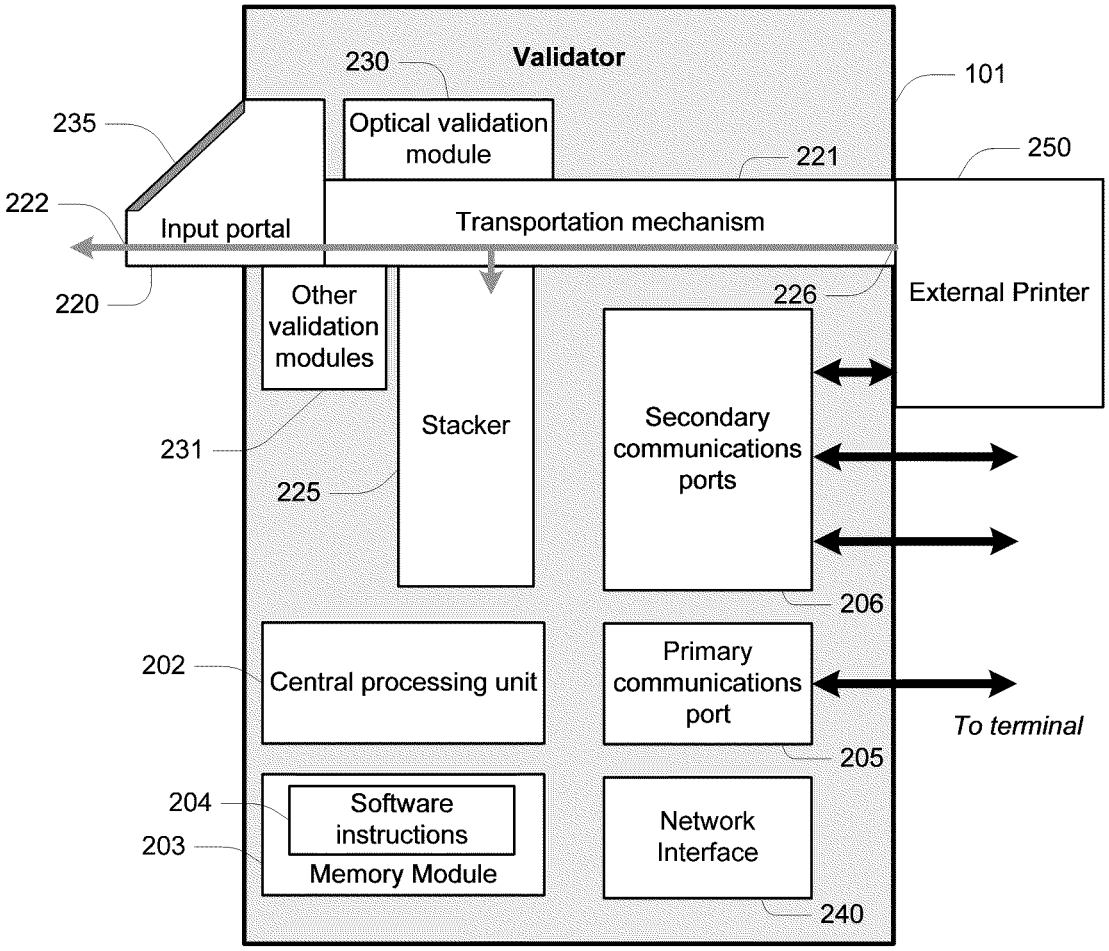
FIG. 2B is a schematic representation of a validator according to one embodiment.
Figure 2C:
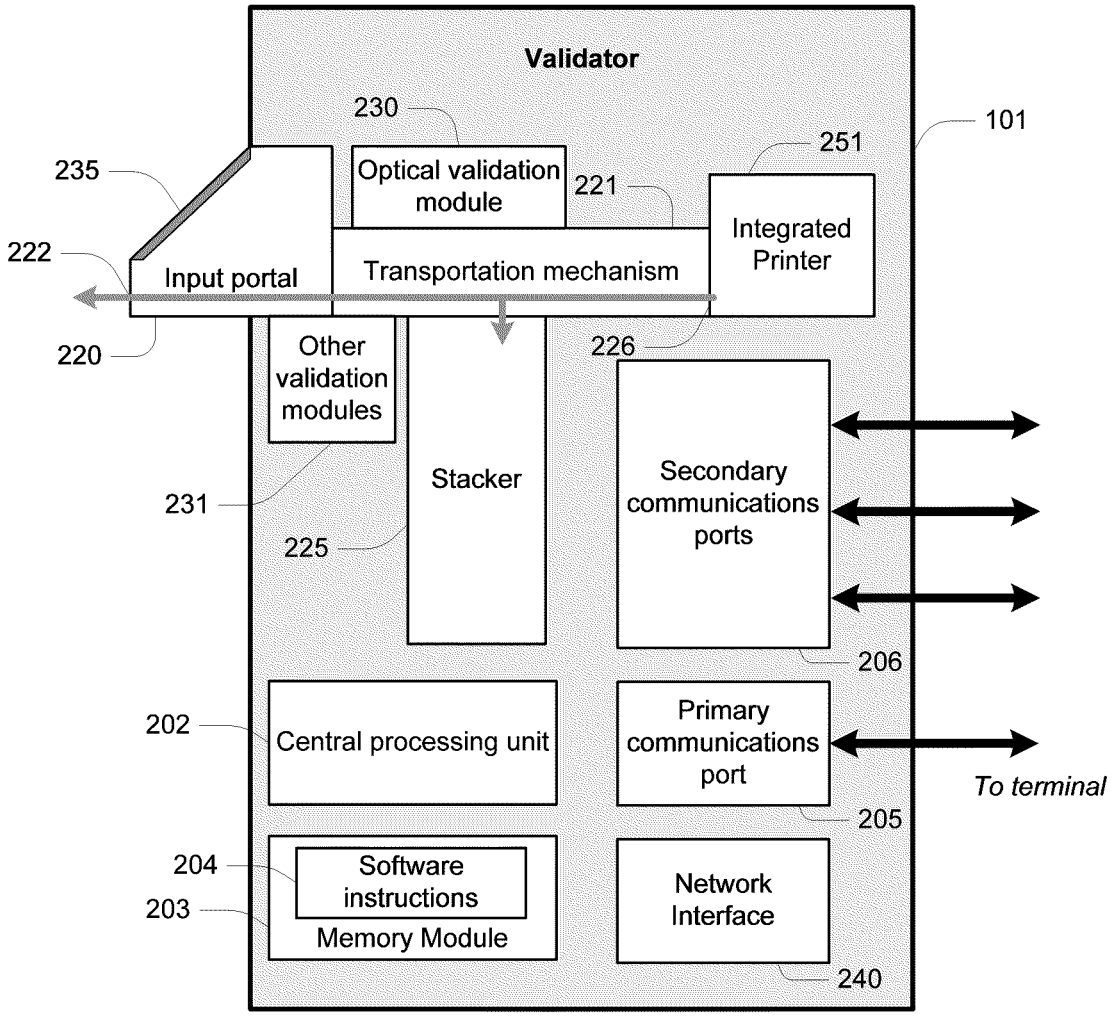
FIG. 2C is a schematic representation of a validator according to one embodiment.

The ticket printer may be an external printer 250, as shown in FIG. 2B, or an integrated printer 251, as shown in FIG. 2C.

In the case of an external ticket printer 250, in one embodiment a secondary input aperture 226 is located at the rear of the validator, and positioned for interaction with mechanism 221. The secondary input aperture is coupled to an output of a ticket printer such that substrate received from the ticket printer is positioned for transportation by transportation mechanism 221. Validators having appropriate secondary inputs are known, for example in the context of validators configured to dispense currency notes from a reserve stacker. An external ticket printer 250 is preferably coupled to the validator via one of the secondary communications ports, for example by a USB connection. In this manner, instructions originating at the printer are passed to the validator, and action taken in accordance with software instructions 204. Additionally, validator 101 is able to instruct the printer to perform various functionalities (for example printing of specified tickets).

In the case of an integrated printer 251, the validator includes a ticket printer positioned such that such that a substrate delivered by the ticket printer is presented for transportation by transportation mechanism 221. In this case, the printer is coupled to processor 202, and therefore able to interact directly with the processor in accordance with software instructions 204.

In either case (external or integrated), the second signal (in response to which mechanism 221 transports a substrate received from a ticket printer to input aperture 222) is generated in response to a signal from the ticket printer.

Figure 2D:
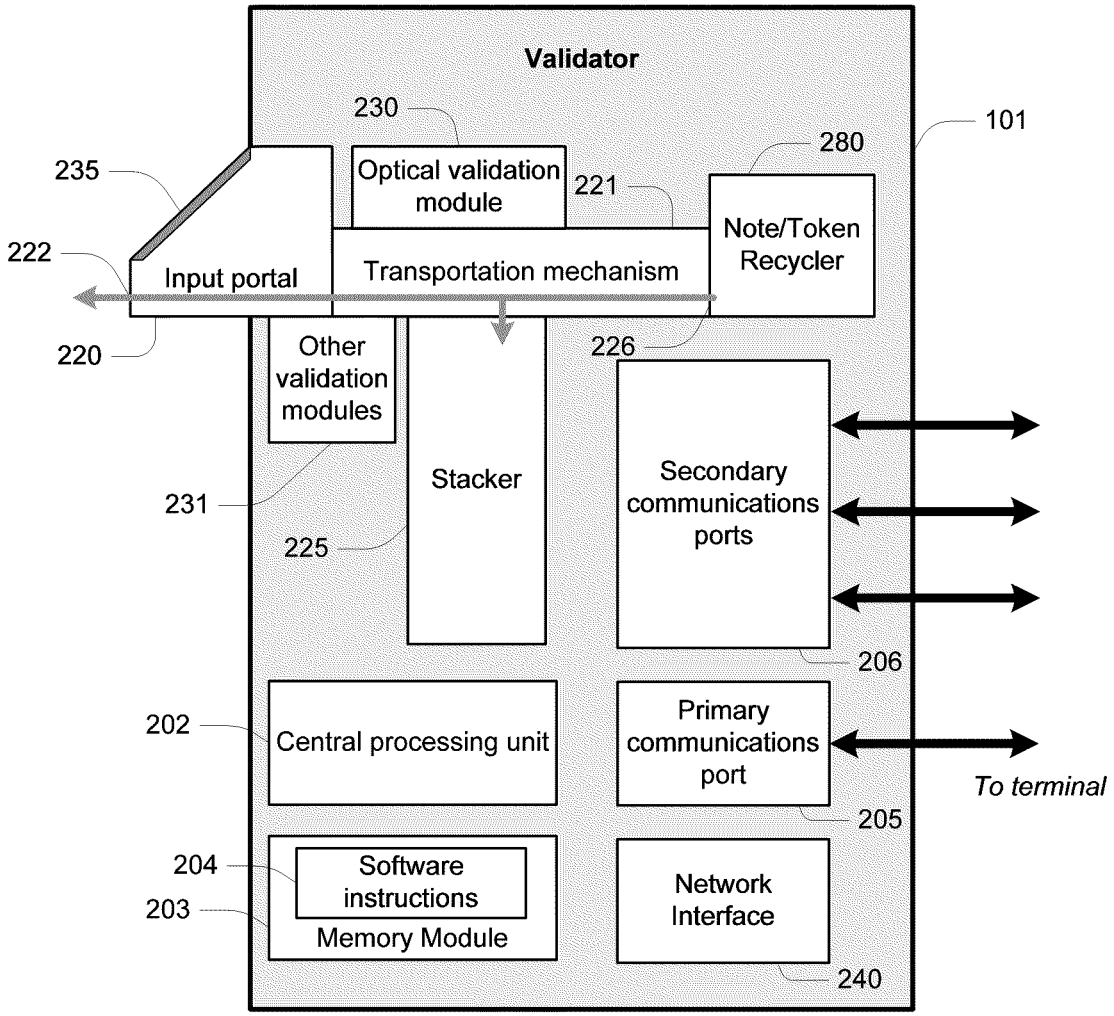
FIG. 2D is a schematic representation of a validator according to one embodiment.

In the embodiment of FIG. 2D, external printer 250 is replaced by a note/token recycler 280. Recycler 208 may be integrated with validator 101, coupled to validator 101, or simply positioned to allow interaction with mechanism 221 as an internal or external component.

In overview, recycler 280 is configured for receiving a substrate from transportation mechanism 221, storing that substrate, and delivering that token to the transportation mechanism following an instruction from the central processing unit. Various forms of suitable recycler are known in the art, for example those provided by Global Payment Technologies, such as the "SMART-CYCLER". In some embodiments recycler 280 is configured to store tokens in a manner that allows for the delivery upon instruction of a specific token or form of token. For instance, in some embodiments recycler 280 is configured to store both currency tokens and non-currency tokens.

In this example, the transportation mechanism 221 is responsive to the CPU to perform any of the following actions:

Transporting a substrate received via a primary input aperture to stacker 225. For example, this is performed in the case of currency and/or non tokens that are not for recycling.

Transporting a substrate received via a primary input aperture to stacker 225 to recycler 280.

Transporting a substrate received from recycler 280 (connected a secondary input location of mechanism 221) to the primary input aperture.

In the present embodiment, recycler 280 allows for the implementation of reusable non-currency tokens, as an alternative to printing tickets. Specifically, reusable non-currency tokens are able to be associated with purpose data which may include, for example, a value in credit that is stored on the token. Upon insertion of the token into the validator, the token is validated and the purpose data identified (for example the token identifier is read, and a database queried to identify associated purpose data). The validator then provides a signal to the terminal based on the purpose data (for example to increase credit by a specified amount). The token is then stored in the recycler. That token is then able to be re-dispensed with different purpose date. For example, if the terminal provides an instruction to the validator to dispense a token having a value of $X, the validator obtains a reusable currency token from the recycler, reads an identifier associated with that non-currency token, and associates that identifier with purpose data corresponding to the value of $X. The validator then provides a signal to a central network, either via a validator network interface or via the terminal, to inform the central network that the identifier in question is associated purpose data corresponding to the value of $X. When that token is inserted into another validator, the validation process includes a subroutine of querying the central server based on the token identifier, thereby to determine the associated purpose data.

The nature of identifier for a reusable non-currency token varies between embodiments, and may be of any form that is readable by a components provided by validator 101. Examples include optically, magnetically, or RF-type readable identifiers.

In some embodiments a smartcard type arrangement (or re-writable RFID) is used such that the purpose data is able to be written to the reusable token, negating the need to store information regarding the association of token identifiers and purpose data at a central location. The reusable non-currency token may be a paper substrate (such as is provided by a ticket printer), or something more sturdy (such as a polymer substrate).

In some embodiments a reusable token is "cleared", in the sense that the associated purpose data is removed, at the time of validation (i.e. prior to being provided to the recycler). However, in other embodiments the token is cleared only when being re-associated with new purpose data prior to being dispensed. In some embodiments the terminal is responsible for managing token identifiers and purpose data, as opposed to the validator. That is, in some cases the validator is never informed of the purpose data, and deals solely in token identifiers.

It will be appreciated that the use of reusable non-currency tokens provides a useful alternative to a ticket printer. The same overall functionality is able to be provided (i.e. dispensing of non-currency tokens with identifiers associated with purpose data), but without the need to print a new token each time a token is required to be dispensed.

In some embodiments validator 101 operates in conjunction with a bezel at input portal 220, the bezel including a display screen 235. In some such cases one of the secondary communications ports is configured for coupling to the bezel and/or display screen, the memory unit and CPU being configured for driving the display screen. In other cases the validator is considered to include a bezel having a display screen 235, and again the memory unit and CPU are configured for driving the display screen. The display screen may be positioned above or below primary input aperture 222. In some embodiments components such as a card reader, RFID reader, and the like are located substantially adjacent screen 235.

In some embodiments the display screen includes a plurality of LEDs arranged to allow presentation of controllable alphanumeric information under instructions of the central processing unit. That is, sufficient LEDs are provided to allow the formation of alphanumeric characters (as opposed to simply back-lighting a printed or cut-out symbol). More preferably, the display screen includes a LCD display, which is optionally configured for providing video data. Such an LCD display allows for particularly rich content (including the likes of advertising and animated games) to be displayed.

In the present embodiments, the validator includes an input mechanism (such as a touch-based input mechanism provided via the display screen, or a plurality of buttons) for allowing a user to provide input signals to the validator and/or terminal.

The function of display 235 varies between embodiments, with some embodiments providing one or more of the following:

- In some embodiments the display screen is configured for providing diagnostic information in relation to the validator. For example, a user navigates menus using the input mechanism to access diagnostic information, for example in terms of validator performance, note acceptances, and so on.
- In some embodiments the display screen is configured for providing diagnostic information in relation to the terminal. That is, the validator is configured to obtain information from the terminal, and provide that information via display 235.
- In some embodiments the display screen is configured for providing a game or other consumer enticement. For example, the display may allow for a game of video poker, which may be separate or linked to a gaming activity inherently provided via the terminal. The input mechanism allows a user to interact with the game or other enticement.
- In some embodiments the display screen is configured for providing visual information in response to instructions provided by third party devices, these instructions being received via the terminal and primary communications port, or via the secondary communications ports.
- In some embodiments the display provided information regarding a user's interaction with input portal 220. For example, this may be in terms of tokens provided, identification information, and so on.

It will be appreciated that the provision of such a display via a validator allows for significant advantages in terms of modifying and/or enhancing the operation of the terminal.

As noted, input portal 220 is configured for receiving multiple forms of token, including physical substrates for providing payment, such as currency notes. In some embodiments the input portal is configured for receiving at least one form of token in physical form (such as a ticket or currency note), and at least one form of token in digital form (for example a token remotely read from an RFID tag or the like). In various embodiments, the input portal is configured for receiving tokens in any one or more of the following forms:

- Currency notes.
- Non-currency printed substrates.
- RFID (radio frequency identification) or other wirelessly readable tokens (such as short-distance wireless device, "near field" devices).
- Smart cards.
- Magnetically readable substrates.
- Optically readable substrates.

In essence, input portal 220 defines a token acceptance zone (which is effectively a functionally/notionally defined region in three dimensional space) into which a token of any of the multiple forms is presented for receiving by the input portal. For example, the zone contains or is adjacent to an aperture into which physical substrates are able to be inserted, with RFID tags and the like being readable adjacent that aperture. The general notion is that the input portal defines a common physical location at which token are presented thereby to interact with the validator/terminal.

Portal 220 operates in conjunction with validation modules, such as an optical validation module 230 (for reading data from substrates inserted into the validator, such as currency notes and/or printed tickets) and other validation modules 231 (for reading the likes of RFID tags, magnetic strips, smartcards, and so on).

The use of multiple forms of token is significant in the sense that tokens may serve different functions. For example, in some embodiments one or more particular form of token are used for purposes other than providing payment. For example, one form of token may be used for identification purposes (for example in the context of a loyalty card arrangement or for security purposes), and/or to access administrator functionalities of the validator and/or terminal (for example in terms of accessing diagnostic information).

In one embodiment, a validator such as validator 101 is used to apply usage limitations on a gaming machine (or for that matter any form of terminal). In some jurisdictions, regulations are under consideration whereby a user must provide individualized information (for example identification and/or information concerning playing statistics) before access to use a gaming machine is granted. Compliance with such a regulation is particularly challenging for gaming operators, as it would generally require substantive modifications to gaming machines themselves (and such modifications are heavily regulated). However, the present validator technology allows compliance to be achieved through the validator. It will be recognized that a validator provides a sole entry point for gaming, in the sense that credit must be purchased via the validator. By selectively allowing or blocking the ability for a player to purchase credit (for example based on analysis of a token in the form of an RFID tag provided via portal 220), functionality is provided to allow compliance.

Following on from the above points, in some embodiments validator 101 includes a validation module for validating a payment token thereby to determine whether the payment token is to be accepted or rejected, and an identification token reader for reading an identification token provided by a user of the terminal. The identification token reader may be a RFID reader, magnetic strip reader, or the like (depending on the nature of player ID device that is carried in a given implementation). Typically, in such scenarios, the input portal is operative only in the case that the identification token reader recognizes that an identification token is present. That is, a player must provide their ID before they can use a terminal's validator.

In overview, the validator is configured to selectively accept or reject a payment token responsive to assessment of a read identification token, such that the decision to accept or reject a payment token is responsive to the identification of the user present at the terminal when the payment terminal is provided. In this manner, the player ID is used as a means to allow/deny access to use a terminal by providing selective access to the validator.

In some such embodiments, the input portal is configured to receive currency tokens, and the decision to selectively accept or reject a currency token includes assessment of player characteristics associated with the read identification token. The player characteristics associated with the read identification token include historical payment data for the user, for example to limit how much a player is able to lose/spend over a predetermined period.

In some such embodiments the input portal is configured to receive non-currency tokens, wherein each non-currency token is associated with identification data. The non currency token is accepted only in the case that the identification data associated with the non-currency token corresponds to the identification token read by the identification token reader. For example, this can provide security in a cashless gaming environment. A player is provided a ticket having a monetary value, but that ticket is only able to be used by a player having the corresponding identification token.

Following on from the above example, in some embodiments validator 101 is responsive to the presentation of a first form of token for selectively adopting a different mode of operation. For example, depending on data read from that token, the validator may progress to a mode of operation whereby currency notes are (or are not) accepted, a mode for allowing an administrator to perform otherwise restricted tasks, and so on.

In the present embodiment, validator 101 additionally includes a network interface 240 coupled to the central processing unit. This network interface allows the validator to participate in a validator network including a plurality of validators. Memory 203 and processor 202 are in some embodiments configured to seek instructions from the central server in response to one or more local events at the validator. In some embodiments memory 203 and processor 202 are configured to accept configuration and/or firmware data via the network interface. This is particularly advantageous in the sense that such configurationally modifications and/or firmware updates are particularly troublesome and time consuming in the context of known validators. In some cases the networking allows for monitoring of terminals by a central server (for example to assist in stock management for a vending machine).

Network interface 240 may include one or a plurality of individual network interfaces. Examples of network interfaces include GSM/GPRS modules, WiFi, wireless or wired Ethernet, Bluetooth, RF communications, and the like.

Figure 3A:
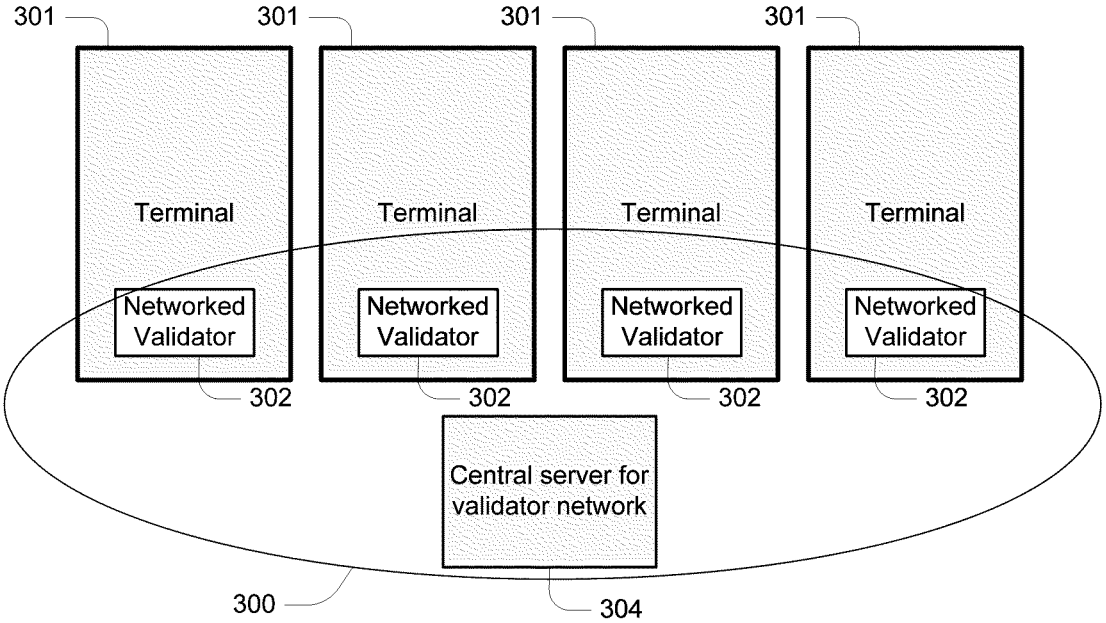
FIG. 3A is a schematic representation of a validator network according to one embodiment.

An exemplary validator network 300 is schematically illustrated in FIG. 3A, which shows a plurality of terminals 301 each having a respective validator 302, these being connected to form a validator network 303. The network additionally includes a central server 304. This arrangement is particularly useful in terms of providing networked functionalities to terminals that otherwise would not be networkable. Instructions from a central server are provided to such terminals via their respective validators. This is optionally used to network gaming machines that do not have network capabilities, and provides an advantageous solution in the sense that various regulatory approvals for modifying the operation if a gaming machine controller may be avoided by running functionality through the validator.

Figure 3B:
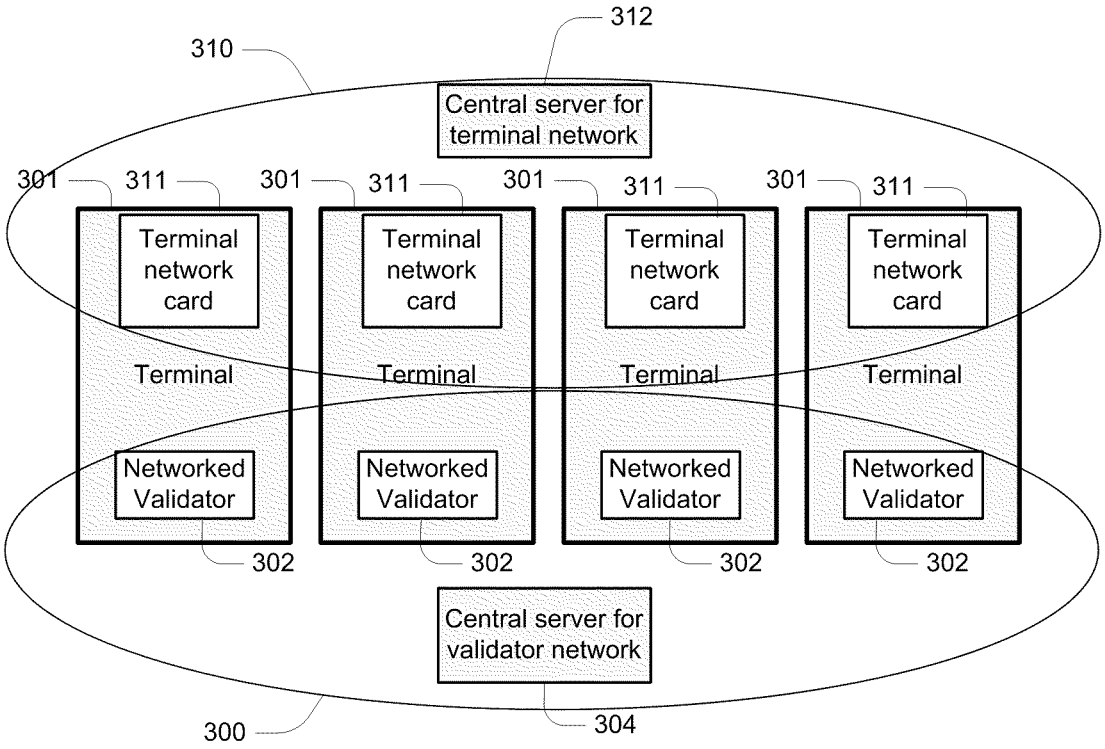
FIG. 3B is a schematic representation of a validator network according to one embodiment.

In the example of FIG. 3B, a validator network 300 operates in conjunction with a terminal network 310. That is, each terminal 301 includes a respective network interface 311 that enables them to communicate with a central server 312 over network 310. This is also advantageous in a gaming environment, in the sense that a front-end network such as network 300 is not subject to the same sorts of regulatory approvals as a back-end network such as network 310, therefore allowing for additional flexibility and functionality to be provided. For example, a first linked jackpot is operated based on contributions taken from accepted payment tokens (such as currency notes), allowing for a linked jackpot external of and invisible to the gaming machine's ventral controller.

It will be appreciated that the disclosure above provides various significant systems and methods for interaction with a terminal. For example, validators of the sort considered above find application in the following contexts:

- Automated checkouts have one device for cash input, another device for cash dispensing, another device for magnetic stripe/smart card reading, another device for pin number entry, another device for signature, and another device to issue receipts. This requires a lot of space and interconnection. Each of these devices communicate with its own protocol, interface and power supply requirements, which greatly increases the design complexity.
- Electronic gaming machines often have one device for receiving cash or barcoded coupons and another device for issuing barcoded coupons. Both these devices take up a lot of space and require intricate mounting arrangements. Furthermore, if the gaming machine has player tracking, then the player needs to be aware and monitor at least three separate points on the machine.

The present embodiments assist in simplifying and combining such components (and others) into the one unit, greatly simplifying the connection, communication, power, space, and mounting requirements for all applications. The user or player has only one interface to deal with both logically and physically.

Unless specifically stated otherwise, as apparent from the following discussions, it is appreciated that throughout the specification discussions utilizing terms such as "processing," "computing," "calculating," "determining", analyzing" or the like, refer to the action and/or processes of a computer or computing system, or similar electronic computing device, that manipulate and/or transform data represented as physical, such as electronic, quantities into other data similarly represented as physical quantities.

In a similar manner, the term "processor" may refer to any device or portion of a device that processes electronic data, e.g., from registers and/or memory to transform that electronic data into other electronic data that, e.g., may be stored in registers and/or memory. A "computer" or a "computing machine" or a "computing platform" may include one or more processors.

The methodologies described herein are, in one embodiment, performable by one or more processors that accept computer-readable (also called machine-readable) code containing a set of instructions that when executed by one or more of the processors carry out at least one of the methods described herein. Any processor capable of executing a set of instructions (sequential or otherwise) that specify actions to be taken are included. Thus, one example is a typical processing system that includes one or more processors. Each processor may include one or more of a CPU, a graphics processing unit, and a programmable DSP unit. The processing system further may include a memory subsystem including main RAM and/or a static RAM, and/or ROM. A bus subsystem may be included for communicating between the components. The processing system further may be a distributed processing system with processors coupled by a network. If the processing system requires a display, such a display may be included, e.g., a liquid crystal display (LCD) or a cathode ray tube (CRT) display. If manual data entry is required, the processing system also includes an input device such as one or more of an alphanumeric input unit such as a keyboard, a pointing control device such as a mouse, and so forth. The term memory unit as used herein, if clear from the context and unless explicitly stated otherwise, also encompasses a storage system such as a disk drive unit. The processing system in some configurations may include a sound output device, and a network interface device. The memory subsystem thus includes a computer-readable carrier medium that carries computer-readable code (e.g., software) including a set of instructions to cause performing, when executed by one or more processors, one of more of the methods described herein. Note that when the method includes several elements, e.g., several steps, no ordering of such elements is implied, unless specifically stated. The software may reside in the hard disk, or may also reside, completely or at least partially, within the RAM and/or within the processor during execution thereof by the computer system. Thus, the memory and the processor also constitute computer-readable carrier medium carrying computer-readable code.

Furthermore, a computer-readable carrier medium may form, or be included in a computer program product.

In alternative embodiments, the one or more processors operate as a standalone device or may be connected, e.g., networked to other processor(s), in a networked deployment, the one or more processors may operate in the capacity of a server or a user machine in server-user network environment, or as a peer machine in a peer-to-peer or distributed network environment. The one or more processors may form a personal computer (PC), a tablet PC, a set-top box (STB), a Personal Digital Assistant (PDA), a cellular telephone, a web appliance, a network router, switch or bridge, or any machine capable of executing a set of instructions (sequential or otherwise) that specify actions to be taken by that machine.

Note that while some diagrams only show a single processor and a single memory that carries the computer-readable code, those in the art will understand that many of the components described above are included, but not explicitly shown or described in order not to obscure the inventive aspect. For example, while only a single machine is illustrated, the term "machine" shall also be taken to include any collection of machines that individually or jointly execute a set (or multiple sets) of instructions to perform any one or more of the methodologies discussed herein.

It will be understood that the steps of methods discussed are performed in one embodiment by an appropriate processor (or processors) of a processing (i.e., computer) system executing instructions (computer-readable code) stored in storage. It will also be understood that the invention is not limited to any particular implementation or programming technique and that the invention may be implemented using any appropriate techniques for implementing the functionality described herein. The invention is not limited to any particular programming language or operating system.

Similarly it should be appreciated that in the above description of exemplary embodiments of the invention, various features of the invention are sometimes grouped together in a single embodiment, FIG., or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

Similarly, it is to be noticed that the term coupled, when used in the claims, should not be interpreted as being limited to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

The claims defining the invention are as follows:

1. A validator for operation with an electronic gaming machine, the electronic gaming machine being configured to provide a game of chance that is played in exchange for gaming credits, the validator including:

a central processing unit;

a memory module communicably coupled to the central processing unit, the memory module configured to maintain software instructions that are executable via the central processing unit;

a primary communications port communicably coupled to the central processing unit, wherein the primary communications port is configured to enable communications between the validator to the electronic gaming machine to allow interaction between the validator and the electronic gaming machine;

an input portal communicably coupled to the central processing unit, wherein the input portal is configured to receive multiple forms of token via a common aperture, wherein one of the forms of token is a currency note and another of the forms of token is a predetermined form of reusable read-only non-currency token having no writable regions;

a token recycling device configured to hold a plurality of the reusable read-only non-currency tokens of the predetermined form;

a transportation mechanism communicably coupled to the central processing unit, wherein the transportation mechanism is configured to transport a reusable read-only non-currency token of the predetermined form received via the input portal to the token recycling device, and further configured to transport a reusable read-only non-currency token of the predetermined form from the token recycling device to the input portal; and a token reader intermediate the input portal and the token recycling device, the token reader being configured to read an identifier from reusable read-only non-currency tokens of the predetermined form passed from the input portal to the token recycling device and configured to read an identifier from reusable read-only non-currency tokens of the predetermined form passed from the token recycling device to the input portal;

wherein, in response to a player of the electronic gaming machine providing a request to cash out a specified value of gaming credits, the validator is configured to:

(i) transport a reusable read-only non-currency token of the predetermined form from the token recycling device to the input portal for delivery to the player without writing data to the reusable read-only non-currency token;

(ii) read the identifier from that reusable read-only non-currency token without writing data to the reusable read-only non-currency token; and (iii) associate the read identifier with a value corresponding to the specified value of gaming credits without writing data to the reusable read-only non-currency token; and (iv) store the value corresponding to the specified value of gaming credits in a central network that maintains data indicative of association of a plurality of reusable read-only non-currency tokens of the predetermined form with respective values;

such that a further device is subsequently able to receive and read that reusable read-only non-currency token and, based on the identifier, access the central network to determine the specified value of gaming credits associated with that token.

2. A validator according to claim 1, wherein a signal is provided to a central network, the signal being indicative of the association of the read identifier with the value corresponding to the specified value of gaming credits.

3. A validator according to claim 2, wherein the signal is provided to the central network by the validator.

4. A validator according to claim 2, wherein the signal is provided to the central network by the electronic gaming machine.

5. A method performed by a validator, in operation with an electronic gaming machine, the electronic gaming machine being configured to provide a game of chance that is played in exchange for gaming credits, the validator including:

a central processing unit;

a memory module communicably coupled to the central processing unit, the memory module configured to maintain software instructions that are executable via the central processing unit;

a primary communications port communicably coupled to the central processing unit, wherein the primary communications port is configured to enable communications between the validator and the electronic gaming machine to allow interaction between the validator and the electronic gaming machine;

an input portal communicably coupled to the central processing unit, wherein the input portal is configured to receive multiple forms of token via a common aperture, wherein one of the forms of token is a currency note and another of the forms of token is a predetermined form of reusable read-only non-currency token having no writable regions;

a token recycling device configured to hold a plurality of the reusable read-only non-currency tokens of the predetermined form;

a transportation mechanism communicably coupled to the central processing unit, wherein the transportation mechanism is configured to transport a reusable read-only non-currency token of the predetermined form received via the input portal to the token recycling device, and further configured to transport a reusable read-only non-currency token of the predetermined form from the token recycling device to the input portal; and a token reader intermediate the input portal and the token recycling device, the token reader being configured to read an identifier from reusable read-only non-currency tokens of the predetermined form passed from the input portal to the token recycling device and configured to read an identifier from reusable read-only non-currency tokens of the predetermined form passed from the token recycling device to the input portal;

the method comprising:

receiving a token via the input portal;

analyzing the received token by at least one of the central processing unit or the token reader to determine whether the token is a predefined form of reusable read-only non-currency token;

in the case that the token is a predefined form of reusable read-only non-currency token:

(i) analyzing the token thereby to read a token identifier;

(ii) determining a value corresponding to a specified value of gaming credits associated with the token identifier, wherein determining the value corresponding to the specified value of gaming credits includes obtaining data from a central network that maintains data indicative of association of a plurality of reusable read-only non-currency tokens of the predetermined form with respective values;

(iii) providing a signal to the electronic gaming machine indicative of the determined specified value of gaming credits, thereby to increase a value of playable gaming credits available to a player of the gaming machine by that specified value; and (iv) storing the token in the token recycling device, such that the token can subsequently be dispensed from the validator in response to a subsequent request to cash out a further specified value of gaming credits, wherein corresponding to the subsequent dispensing the token identifier is associated with a value corresponding to that further specified value of gaming credits.

6. A method performed by a validator in operation with an electronic gaming machine, the electronic gaming machine being configured to provide a game of chance that is played in exchange for gaming credits, the validator including:

a central processing unit;

a memory module communicably coupled to the central processing unit, the memory module configured to maintain software instructions that are executable via the central processing unit;

a primary communications port communicably coupled to the central processing unit, wherein the primary communications port is configured to enable communications between the validator and the electronic gaming machine to allow interaction between the validator and the electronic gaming machine;

an input portal communicably coupled to the central processing unit, wherein the input portal is configured to receive multiple forms of token via a common aperture, wherein one of the forms of token is a currency note and another of the forms of token is a predetermined form of reusable read-only non-currency token having no writable regions;

a token recycling device configured to hold a plurality of the reusable read-only non-currency tokens of the predetermined form;

a transportation mechanism communicably coupled to the central processing unit, wherein the transportation mechanism is configured to transport a reusable read-only non-currency token of the predetermined form received via the input portal to the token recycling device, and further configured to transport a reusable read-only non-currency token of the predetermined form from the token recycling device to the input portal; and a token reader intermediate the input portal and the token recycling device, the token reader being configured to read an identifier from reusable read-only non-currency tokens of the predetermined form passed from the input portal to the token recycling device and configured to read an identifier from reusable read-only non-currency tokens of the predetermined form passed from the token recycling device to the input portal;

the method including:

(i) receiving data indicative of a request to cash out a specified value of gaming credits;

(ii) in response to the request, transporting a reusable read-only non-currency token of the predetermined form from the token recycling device to the input portal for delivery to the player without writing data to the reusable read-only non-currency token;

(iii) reading the identifier from that reusable read-only non-currency token without writing data to the reusable read-only non-currency token;

(iv) associating the read identifier with a value corresponding to the specified value of gaming credits without writing data to the reusable read-only non-currency token; and (v) storing the value corresponding to the specified value of gaming credits in a central network that maintains data indicative of a plurality of reusable read-only non-currency tokens of the predetermined form with respective values;

such that a further device is subsequently able to receive and read that reusable read-only non-currency token and, based on the identifier, access the central network to determine the specified value of gaming credits associated with that token.

7. A method according to claim 6, wherein a signal is provided to a central network, the signal being indicative of the association of the read identifier with the value corresponding to the specified value of gaming credits.

8. A method according to claim 7 wherein the signal is provided to the central network by the validator.

9. A method according to claim 7 wherein the signal is provided to the central network by the electronic gaming machine.

10. A validator for operation with an electronic gaming machine, the gaming machine being configured to provide a game of chance that is played in exchange for gaming credits, the validator including:

a central processing unit;

a memory module communicably coupled to the central processing unit, the memory module configured to maintain software instructions that are executable via the central processing unit;

a primary communications port communicably coupled to the central processing unit, wherein the primary communications port is configured to enable communications between the validator to the electronic gaming machine to allow interaction between the validator and the gaming machine;

an input portal communicably coupled to the central processing unit, wherein the input portal is configured to receive multiple forms of token via a common aperture, wherein one of the forms of token is a currency note and another of the forms of token is a predetermined form of reusable read-only non-currency token having no writable regions;

a token recycling device configured to hold a plurality of the reusable read-only non-currency tokens of the predetermined form;

a transportation mechanism communicably coupled to the central processing unit, wherein the transportation mechanism is configured to transport a reusable read-only non-currency token of the predetermined form received via the input portal to the token recycling device, and further configured to transport a reusable read-only non-currency token of the predetermined form from the token recycling device to the input portal; and a token reader intermediate the input portal and the token recycling device, the token reader being configured to read an identifier from reusable read-only non-currency tokens of the predetermined form passed from the input portal to the token recycling device and configured to read an identifier from reusable read-only non-currency tokens of the predetermined form passed from the token recycling device to the input portal;

wherein, upon receipt of a token via the input portal, the validator is configured to:

analyze the received token by at least one of the central processing unit or the token reader to determine whether the token is a predefined form of reusable read-only non-currency token;

in the case that the token is a predefined form of reusable read-only non-currency token:

(i) analyzing the token thereby to read a token identifier;

(ii) determining a value corresponding to a specified value of gaming credits associated with the token identifier, wherein determining the value corresponding to the specified value of gaming credits includes obtaining data from a central network that maintains data indicative of association of a plurality of reusable read-only non-currency tokens of the predetermined form with respective values;

(iii) providing a signal to the electronic gaming machine indicative of the determined specified value of gaming credits, thereby to increase a value of playable gaming credits available to a player of the gaming machine by that specified value; and (iv) storing the token in the token recycling device, such that the token can subsequently be dispensed from the validator in response to a subsequent request to cash out a further specified value of gaming credits; and wherein, in response to a player of the gaming machine providing a request to cash out a specified value of gaming credits, the validator is configured to:

(i) transport a reusable read-only non-currency token of the predetermined form from the token recycling device to the input portal for delivery to the player without writing data to the reusable read-only non-currency token;

(ii) read the identifier from that reusable read-only non-currency token without writing data to the reusable read-only non-currency token;

(iii) associate the read identifier with a value corresponding to the specified value of gaming credits without writing data to the reusable read-only non-currency token; and (iv) store the value corresponding to the specified value of gaming credits in the central network;

such that a further device is subsequently able to receive and read that reusable read-only non-currency token and, based on the identifier, access the central network to determine the specified value of gaming credits associated with that token.

* * * * *